US009458661B2

(12) United States Patent
Farrell et al.

(10) Patent No.: US 9,458,661 B2
(45) Date of Patent: Oct. 4, 2016

(54) SLIDING DOOR WITH TORTUOUS LEADING EDGE PATH

(71) Applicant: Veritas Medical Solutions, LLC, Malvern, PA (US)

(72) Inventors: David P. Farrell, Malvern, PA (US); Herbert Todd Ferrence, Green Lane, PA (US)

(73) Assignee: VERITAS MEDICAL SOLUTIONS LLC, Harleysville, PA (US)

( * ) Notice: Subject to any disclaimer, the term of this patent is extended or adjusted under 35 U.S.C. 154(b) by 0 days.

(21) Appl. No.: 14/215,797

(22) Filed: Mar. 17, 2014

(65) Prior Publication Data

US 2014/0259929 A1 Sep. 18, 2014

Related U.S. Application Data

(60) Provisional application No. 61/787,702, filed on Mar. 15, 2013.

(51) Int. Cl.

| | |
|---|---|
| ***E06B 5/18*** | (2006.01) |
| ***E06B 3/46*** | (2006.01) |
| ***E05F 15/00*** | (2015.01) |
| *E06B 7/24* | (2006.01) |
| *E05F 17/00* | (2006.01) |
| *E05F 15/73* | (2015.01) |

(52) U.S. Cl.

CPC ..... *E06B 5/18* (2013.01); *E05F 15/00* (2013.01); *E06B 3/469* (2013.01); *E06B 3/4636* (2013.01); *E05F 15/73* (2015.01); *E05F 17/004* (2013.01); *E05Y 2900/132* (2013.01); *E06B 7/24* (2013.01)

(58) Field of Classification Search

USPC ..... 49/103, 116, 120, 366, 367, 369, 370

See application file for complete search history.

(56) References Cited

U.S. PATENT DOCUMENTS

| | | | | |
|---|---|---|---|---|
| 133,359 | A * | 11/1872 | Darley | 49/370 |
| 3,175,254 | A | 3/1965 | Bromann, Jr. | |
| 3,432,966 | A * | 3/1969 | Bordner | 49/368 |
| 3,461,611 | A | 8/1969 | Axe | |
| 4,304,071 | A * | 12/1981 | Obrecht | 49/26 |
| 5,433,031 | A | 7/1995 | Dailey | |
| 5,712,516 | A * | 1/1998 | Kabout | 310/12.04 |
| 6,164,417 | A * | 12/2000 | Oberleitner | 187/319 |
| 6,289,643 | B1 | 9/2001 | Bonar | |
| 6,446,759 | B1 * | 9/2002 | Kulak et al. | 187/330 |
| 6,508,332 | B2 * | 1/2003 | Fahl et al. | 187/316 |
| 6,910,301 | B2 * | 6/2005 | Kalempa et al. | 49/368 |
| 7,143,871 | B2 * | 12/2006 | Wesson et al. | 187/334 |
| 7,537,091 | B2 * | 5/2009 | Fargo | 187/316 |
| 7,603,813 | B2 | 10/2009 | Hackl | |
| 8,006,436 | B2 * | 8/2011 | McDaniel | 49/370 |
| 8,283,645 | B2 * | 10/2012 | Guneysel | A61N 5/10 250/505.1 |
| 9,183,957 | B2 * | 11/2015 | Farrell | G21F 1/04 |
| 2004/0192187 | A1 | 9/2004 | Ashley et al. | |
| 2005/0166473 | A1 | 8/2005 | Jorg | |
| 2008/0088188 | A1 * | 4/2008 | Busch | 310/68 B |

OTHER PUBLICATIONS

International Preliminary Report On Patentability for PCT Application No. PCT/US2014/030313, dated Mar. 2, 2015.

International Search Report and Written Opinion for PCT Application No. PCT/US2014/030313, dated Aug. 12, 2014.

* cited by examiner

*Primary Examiner* — Katherine Mitchell
*Assistant Examiner* — Catherine A Kelly
(74) *Attorney, Agent, or Firm* — Volpe and Koenig, P.C.

(57) ABSTRACT

A sliding door assembly is provided comprising a first door having a tortuous leading edge, a door frame, a guide track, and a member having a complementary tortuous edge to that of the door. The drive assembly includes magnets to drive the door between open and closed positions.

14 Claims, 5 Drawing Sheets

SLIDING DOOR WITH TORTUOUS LEADING EDGE PATH

INCORPORATION BY REFERENCE

The following documents are incorporated herein by reference as if fully set forth: U.S. Provisional Application No. 61/787,702, filed Mar. 15, 2013.

FIELD OF INVENTION

This application is generally related to doors and more particularly related to a sliding door assembly.

BACKGROUND

Radiation therapy facilities, especially those involving high energy X radiation or neutron radiation, require particularly thick walls, doors, and barriers. Particle accelerators, such as linear particle accelerators, use electromagnetic fields to propel charged particles, such as electrons, protons, or ions, at high speeds along defined beams. Due to radiation from particle accelerators, particle facilities must be designed and constructed to provide adequate shielding.

Known radiation therapy facilities are generally constructed as a room housing the source of radiation, with concrete walls, ceilings, and floors that can reach thicknesses of up to 15 feet. In addition, a maze entry is usually used to provide a wing wall to capture scatter radiation. The entrance to a maze entry or direct entry radiation therapy room can include at least one shielded door to further prevent radiation leakage outside of the room. The shielded door for a radiation therapy room can be constructed as a hinged door having a very thick core, for example 20 inches thick, to provide sufficient shielding. Known shielded doors are also extremely heavy, typically 10,000-20,000 lbs for radiation therapy rooms, and cannot be opened and closed quickly. The time that it takes to open and close a hinged shielded door is especially important in radiation therapy rooms where an operator may need to enter and exit the room repeatedly to make adjustments. For example, in medical applications, several rounds of low energy radiation may be used for diagnostic purposes and patient positioning before treating the patient's tumor with the high energy radiation. After each round of low energy radiation, the operator must either progress down a very long maze corridor leading to the treatment room or alternatively wait for the shielded door to fully open before entering the treatment room to make adjustments to the patient, and then wait for the shielded door to fully close again before starting the next round of low energy radiation testing or high energy radiation treatment. This process can be very time consuming and tiring to the patient.

Bi-parting sliding doors typically permit shorter opening and closing times compared to hinged doors. Because existing bi-parting sliding doors have a relatively linear leading edge at the seam between both doors, they lack the necessary seal required to prevent radiation leakage. One known method to reduce radiation leakage is to equip one of the bi-parting doors with an astragal at its leading edge to cover the seam between the doors.

The increased speed of heavy radiation shielded doors introduces additional safety concerns especially when objects obstruct the closing path of the sliding doors.

A need exists for a sliding door for radiation therapy rooms that provides a sufficient seal to eliminate radiation leakage and improved safety when closing.

SUMMARY

A sliding door assembly is disclosed. The sliding door assembly can consist of a single sliding door or a bi-parting sliding door, a door frame including a drive assembly, and guide track. The leading edge of the single door or one of the bi-parting doors has a tortuous path, such as a sine-wave shape, which mates with an edge of a fixed member or leading edge of a second door in a bi-parting door assembly having a complementary tortuous path.

The drive assembly directly drives the sliding doors along a linear track using magnetic force, such as magnetic propulsion, to open and close the sliding door assembly.

A secondary door assembly is arranged outside a primary sliding door assembly. The secondary door assembly closes before the primary sliding door assembly. The primary sliding door assembly does not close if the secondary door assembly fails to close. A control system directs the drive assembly. Either or both the primary sliding door assembly and the secondary door assembly can include leading edges having a tortuous path.

BRIEF DESCRIPTION OF THE DRAWINGS

The foregoing summary, as well as the following detailed description of the preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangement shown.

DETAILED DESCRIPTION OF THE PREFERRED EMBODIMENTS

Figure 1:
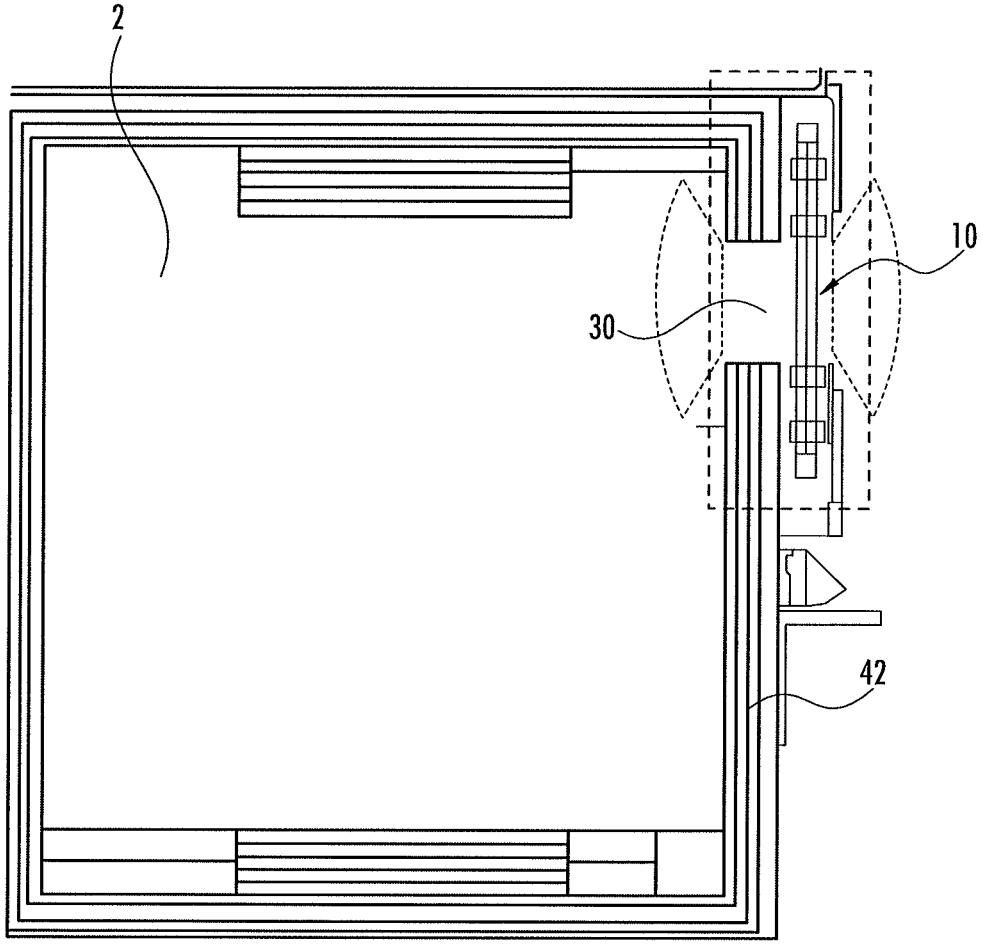
FIG. 1 is a plan view of a direct entry radiation therapy room equipped with a sliding door assembly.

Certain terminology is used in the following description for convenience only and is not limiting. The words "top," "bottom," "inner," and "outer" designate directions in the drawings to which reference is made. The terminology includes the words specifically noted above, derivatives thereof, and words of similar import.

FIG. 1 shows a direct entry radiation therapy room 2 equipped with a sliding door assembly 10. The direct entry radiation therapy room 2 can be a particle facility, proton facility, linear accelerator room, or any other radiation therapy room that can involve high energy radiation, such as high energy X radiation, neutron radiation, proton radiation, X-ray radiation, or the like. Due to the high costs associated with constructing modular radiation facilities, maximizing space within the facility radiation therapy room 2 is desirable. The sliding door assembly 10 is positioned outside an existing entryway 30 formed in a wall 42, such as a shielded wall of the radiation therapy room 2, in order to maximize space within the radiation therapy room.

Figure 2A:
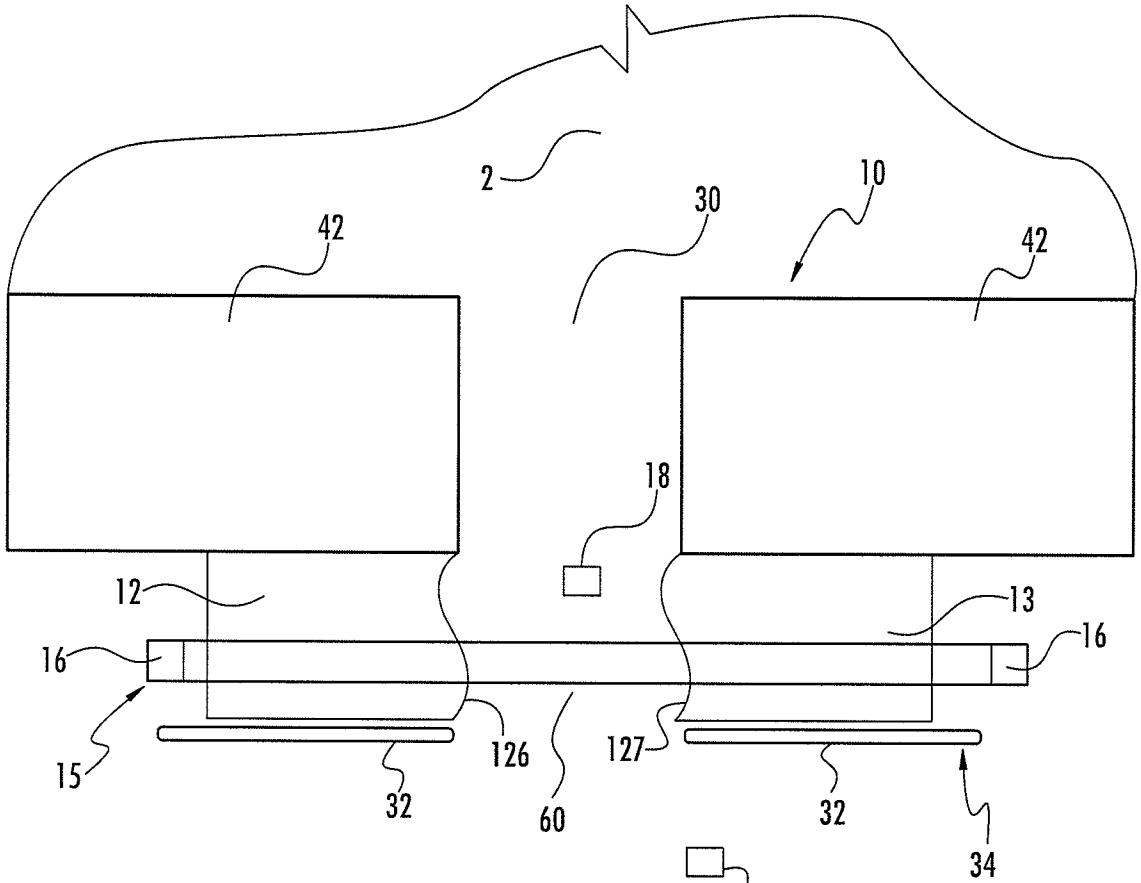
FIG. 2A is a top view of a direct entry radiation therapy room equipped with an embodiment of a bi-parting door assembly having a leading edge in the shape of a sine-wave.
Figure 4:
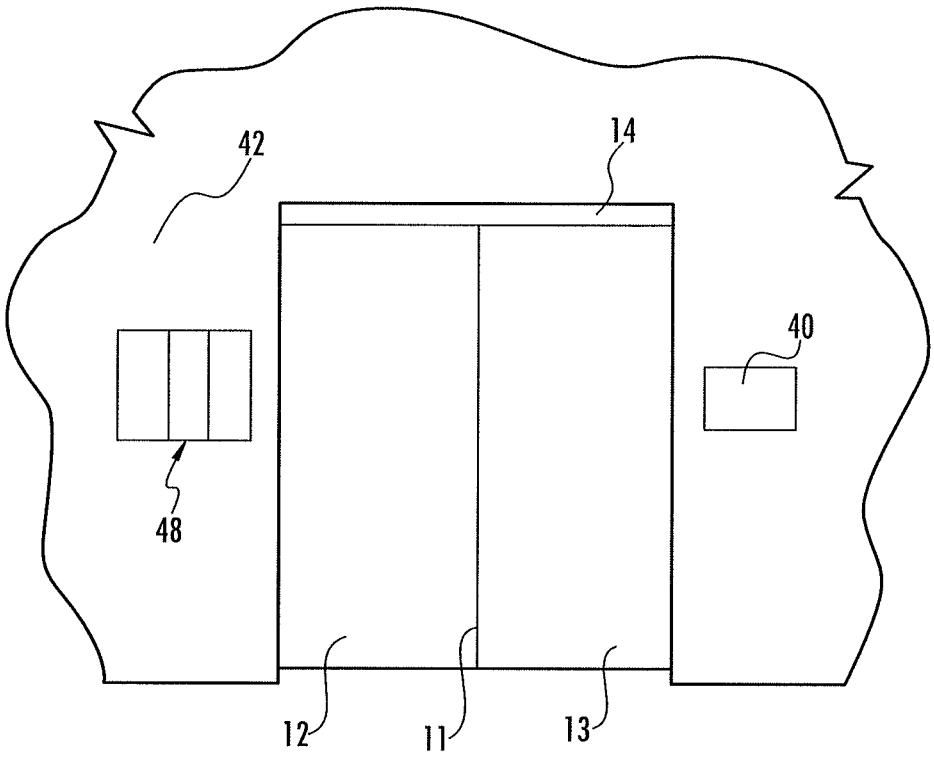
FIG. 4 is a view of the biparting door assembly of FIG. 2A in a closed configuration.

FIG. 2A shows an embodiment of a bi-parting door assembly 10 according to the present invention in an open position. FIG. 4 shows the bi-parting door assembly 10 of FIG. 2A in a closed configuration showing the seam 11 formed by the doors 12, 13. The bi-parting door assembly 10 is positioned outside the entryway 30 and includes two doors 12, 13, a door frame 14, a track 15, and a drive assembly 16. The doors 12, 13 and door frame 14 define a passageway 60 therebetween. The two doors 12, 13 are of sufficient thickness to shield radiation from leaking out of the particle facility, and each door 12, 13 preferably has a thickness of approximately 12 inches to 60 inches, and more preferably has a thickness of 20 inches to 50 inches. In one embodiment, each door 12, 13 has a thickness of approximately 49 inches. In another embodiment, each door 12, 13 has a thickness of approximately 25 inches. Each door 12, 13 preferably weighs approximately 12,000 lbs. to 65,000 lbs., and more preferably weighs 20,000 lbs. to 60,000 lbs. In one embodiment, each door 12, 13 weighs approximately 20,000 lbs. In another embodiment, each door 12, 13 weighs approximately 60,000 lbs. The doors 12, 13 preferably consist of a core constructed of high-density material adapted to reflect, attenuate, or capture charged particles, such as that described in U.S. patent application Ser. No. 13/060,157 and PCT Application Nos. PCT/US2011/036934, which are incorporated by reference as if fully set forth herein. The core of the doors 12, 13 can be comprised of a high-density concrete. In an embodiment, the core of the doors 12, 13 preferably have a density between 200 to 400 pounds per cubic foot, and more preferably have a density of 250 pounds per cubic foot. In another embodiment, the core of the doors 12, 13 preferably have a density of 313 pounds per cubic foot. The core of the doors 12, 13 can be formed from a high-Z material, i.e. a material with a high atomic number and number of protons, such as, for example and without limitation, lead, steel, and tungsten. In another embodiment, the core of the doors 12, 13 can be formed from boron or lithium based materials, which are suitable for capturing neutron particles and byproduct radiation. In another embodiment, the core of the doors 12, 13 can be formed from a metallic aggregate material that can include high-Z materials, such as, for example and without limitation, iron, lead, steel, and tungsten. High-Z target materials which could be used in the core of the doors 12, 13 include but are not limited to copper, aluminum, titanium, and brass. The core of the doors 12, 13 can include a material having high-Z aggregates, high hydrogen content, and/or a high macroscopic neutron cross-section to capture byproduct radiation. Such a material can include, but is not limited to, boron, lithium, cadmium, steel, and carbon. The core of the doors 12, 13 can include any combination of the materials described above, and can include a plurality of layers of any combination of the materials described above.

The outer surface of the doors 12, 13 are preferably constructed of carbon steel plate face panels and a minimum ½ inch thick edge banding along the top, bottom, and trailing edge of the door. The outer surface of the doors 12, 13 can be coated and finished with any suitable material including plastic, wood or metal laminates.

The leading edge of each of the bi-parting doors 12, 13 preferably have complementary tortuous paths to prevent radiation leakage when the doors 12, 13 are closed. The tortuous paths extend the length of the doors 12, 13 in a direction perpendicular to the seam 11 formed between the two doors 12, 13 when the doors 12, 13 are closed.

Figure 2B:
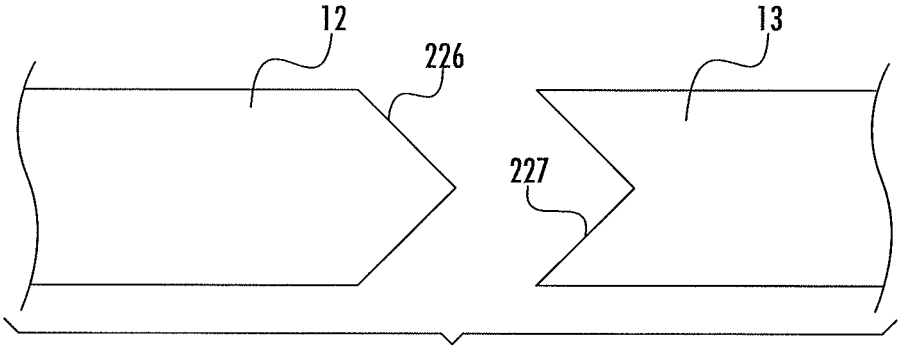
FIG. 2B is a top view of an alternative embodiment of the bi-parting door assembly.
Figure 2C:
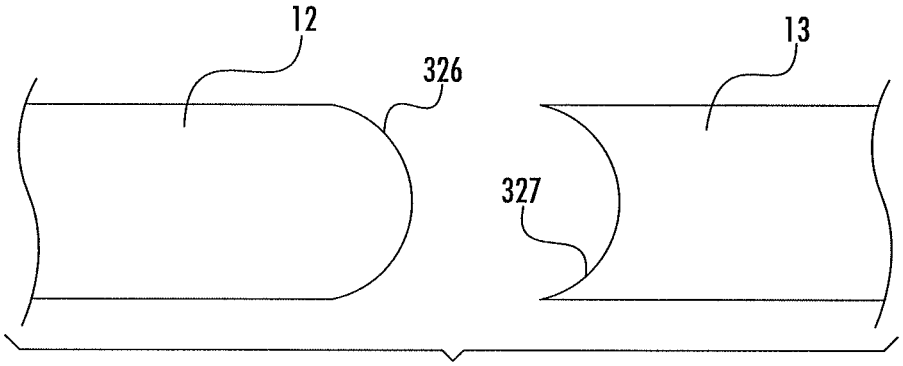
FIG. 2C is a top view of another alternative embodiment of the bi-parting door assembly.

As shown in FIG. 2A. the leading edges of the bi-parting doors 12, 13 can include complementary sine-wave shaped edges 126, 127. Alternatively, as shown in FIG. 2B, the leading edges of the bi-parting doors 12, 13 can include triangular interlocking shaped edges 226, 227. As shown in FIG. 2C, the leading edges of the bi-parting doors 12, 13 can also include interlocking curved edges 326, 327. Any shape of the leading edges is sufficient so long as the leading edges form a tortuous path in a direction that is perpendicular to the seam 11 between the doors 12, 13 to prevent radiation leakage. Due to the tortuous path of the leading edge of the doors 12, 13, astragals are not necessary as are typically required with straight edge doors.

Figure 3:
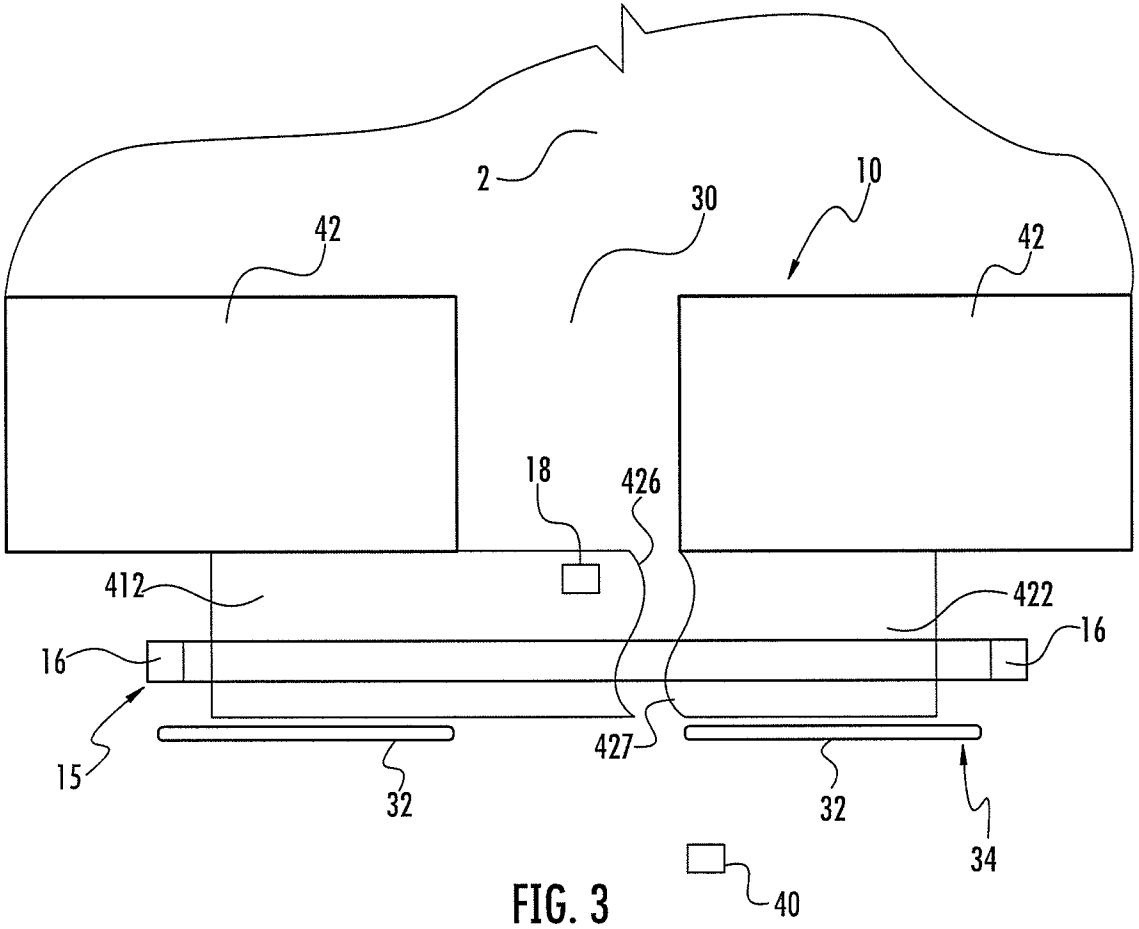
FIG. 3 is a top view a single sliding door.

In an alternate embodiment shown in FIG. 3, the door assembly 10 can consist of a single sliding door 412. The single sliding door 412 has a leading edge 426 with a tortuous path, which can include, but is not limited, to the tortuous paths shown in FIGS. 2A, 2B, and 2C. A fixed member 422, such as, and without limitation, a panel or fixed door, is preferably secured to the wall 42 outside of the radiation therapy room 2 and includes an edge 427 having a complementary tortuous path to the leading edge 426 on the single door 412.

Highly efficient hinged shielded doors used in direct entry radiation therapy rooms take approximately 10-12 seconds to move from an open position to a closed position, and vice-versa. The bi-parting door assembly 10 of the present application can move from an open position to a closed position in approximately 5-6 seconds, which reduces the waiting time for a treatment technician to move in and out of the room.

A drive assembly 16 drives the bi-parting doors 12, 13 or single door 412 between an open and closed configuration. The drive assembly 16 can include any suitable driving mechanism. Preferably, the drive assembly 16 includes magnets to magnetically propel the doors 12, 13 along a track 15 preferable having a linear shape. Because the doors 12, 13 are magnetically propelled, there are fewer mechanical problems related to gears and drive systems. Due to the lack of moving parts in the drive assembly 16, the overall failure rate of the sliding door assembly 10 is reduced. Alternatively, a track support mechanism having guidance rollers can be used to opening and closing the doors 12, 13.

The width of the passageway 60 to the radiation therapy room 2 when the sliding door assembly 10 is open may vary depending on the type of room the sliding door assembly 10 is used in, but should at least be suitable for a person to walk through, for example approximately 36-46 inches wide. In research or medical particle facilities, the passageway 60 may be wider to accommodate equipment to be moved in and out of the room, such as wheel chairs, stretchers, and lab equipment. In addition, the sliding door or doors 12, 13 can be removable in order to create additional space to move equipment in and out of the room.

To prevent the sliding door assembly 10 from closing when a person or object is in the passageway 60, a sensor 18 may be arranged to detect whether an object is in the passageway 60. A sensor 18 may be placed in the floor, ceiling, or in the area adjacent to the sliding door assembly 10 to detect when a person or object is approaching the passageway 60. Preferably, a plurality of sensors are used to enhance accuracy. The sensor 18 may be, for example and without limitation, a pressure sensor arranged in the floor of the sliding door assembly 10, an ultrasonic presence detecting sensor, or an infra-red light sensor. The sensor 18 may be configured to relay signals to a control system 40 which includes a programmable touch screen interface and is electrically connected to the drive assembly 16 to control operation of the sliding door assembly 10. When the sensor 18 detects a person or object in the passageway 60, the control system 40 prevents the drive assembly 16 from moving the door or doors 12, 13.

A secondary sliding door assembly 34 comprised or one or more sliding panels 32 can be positioned exterior to the sliding door assembly 10 as an additional safety precaution against the sliding door assembly 10 closing on a person or object in the passageway 60. The panel or panels 32 are preferably made of a thin, lightweight material, such as plastic or Plexiglas. The panel or panels 32 can be operated to close before the sliding door assembly 10. The panel or panels 32 can be driven by either the same drive assembly 16 or a separate drive assembly as the sliding door assembly 10. The panels 32 are prevented from closing if the sensor 18 detects an object or person within the detection area.

The sliding door assembly 10 preferably operates on a 220 volt, three-phase, 30 amp power supply with low voltage wiring to the drive assembly 16, control system 40, sensor 18, and any other electronic components. In the event of a power failure, the magnetic propulsion drive assembly 16 would fail. The sliding door assembly 10 includes a manual operation mode wherein at least one of the doors 12, 13 and the panel 32 can manually open and close under their own power or by a battery back-up system.

While a sliding door assembly has been described herein, one of ordinary skill in the art would also recognize that the sliding door assembly could also be modified for use as a window. As shown in FIG. 4, a window 48 can be positioned in the wall 42 for an operator or other person to view the radiation therapy room. The window 48 includes a similar single sliding panel or bi-parting sliding panels, track, and drive assembly as described herein with respect to the sliding door assembly.

While various methods, configurations, and features of the present invention have been described above and shown in the drawings, one of ordinary skill in the art will appreciate from this disclosure that any combination of the above features can be used without departing from the scope of the present invention. It is also recognized by those skilled in the art that changes may be made to the above described methods and embodiments without departing from the broad inventive concept thereof.

What is claimed is:

1. A radiation-shielding sliding door assembly for a radiation therapy facility comprising:

a door frame;

a guide track;

a first door slidable along the guide track between open and closed positions and having a front face, a rear face, a trailing face, and a leading face including a sine-wave shaped leading edge, the first door having a core constructed of high-density or high-Z material having radiation-shielding characteristics; wherein radiation is at least one of high energy X radiation, neutron radiation, photon radiation, proton radiation, X ray radiation, gamma radiation, or high energy radiation; and a member having a sine-wave shaped edge that is complementary to the sine-wave shaped leading edge of the door, the member having a core constructed of high-density or high-Z material having radiation-shielding characteristics, wherein when the first door is in the closed position, the sine-wave shaped leading edge of the first door and the sine-weave shaped edge of the member interlock to form a tight seal between the first door and the member to prevent leakage of radiation through the seal.

2. The radiation-shielding sliding door assembly of claim 1, wherein the member is fixed to the door frame.

3. The radiation-shielding sliding door assembly of claim 1, wherein the member is a second door that is slidable along the guide track in a complementary direction to the first door.

4. The radiation-shielding sliding door assembly of claim 3, further comprising a drive assembly to drive the first and second doors between open and closed positions.

5. The radiation-shielding sliding door assembly of claim 1, further comprising a drive assembly to drive the first door between the open and closed positions.

6. The radiation-shielding sliding door assembly of claim 5, wherein the drive assembly includes a magnet system for opening and closing the first door.

7. The radiation-shielding sliding door assembly of claim 5, wherein the drive assembly includes guidance rollers to open and close the first door.

8. The radiation-shielding sliding door assembly of claim 5, wherein a control system directs the drive assembly.

9. The radiation-shielding sliding door assembly of claim 1, wherein a secondary sliding door assembly is arranged outside the first door.

10. The radiation-shielding sliding door assembly of claim 9, wherein the secondary sliding door assembly closes before the first door.

11. The radiation-shielding sliding door assembly of claim 1, wherein the door frame defines an entryway, and at least one sensor is associated with the sliding door assembly to prevent movement of the sliding door assembly when an object is detected by the sensor.

12. The radiation-shielding sliding door assembly of claim 1, wherein the first door and the member each have a thickness of at least 12 inches.

13. The radiation-shielding sliding door assembly of claim 1, wherein the first door and the member each weigh at least 12,000 pounds.

14. The radiation-shielding sliding door assembly of claim 1, wherein the core of the first door and the core of the member each have a density between 200 to 400 pounds per cubic foot.

* * * * *